US008059036B2

(12) United States Patent
Bengtsson

(10) Patent No.: US 8,059,036 B2
(45) Date of Patent: Nov. 15, 2011

(54) ENHANCED RADIATION PERFORMANCE ANTENNA SYSTEM

(75) Inventor: Erik Bengtsson, Esløv (SE)

(73) Assignee: Nokia Corporation, Espoo (FI)

( * ) Notice: Subject to any disclaimer, the term of this patent is extended or adjusted under 35 U.S.C. 154(b) by 974 days.

(21) Appl. No.: 11/810,749

(22) Filed: Jun. 6, 2007

(65) Prior Publication Data

US 2008/0303723 A1 Dec. 11, 2008

(51) Int. Cl.
*H01Q 1/24* (2006.01)

(52) U.S. Cl. ..... 343/702; 343/846

(58) Field of Classification Search ..... 343/702, 343/846, 848

See application file for complete search history.

(56) References Cited

U.S. PATENT DOCUMENTS

| | | | | |
|---|---|---|---|---|
| 6,801,164 | B2 | 10/2004 | Bit-Babik et al. | 343/700 MS |
| 2005/0001768 | A1 * | 1/2005 | Sekiguchi et al. | 343/700 MS |
| 2005/0242996 | A1 | 11/2005 | Palmer et al. | 343/700 MS |
| 2005/0243001 | A1 * | 11/2005 | Miyata et al. | 343/702 |
| 2007/0120748 | A1 * | 5/2007 | Jenwatanavet et al. | 343/702 |
| 2007/0216584 | A1 * | 9/2007 | Nishikido et al. | 343/702 |
| 2010/0073244 | A1 * | 3/2010 | Hui et al. | 343/702 |

FOREIGN PATENT DOCUMENTS

| | | | |
|---|---|---|---|
| WO | WO 2004/017461 | A1 | 2/2004 |
| WO | WO 2005/006486 | A1 | 1/2005 |

* cited by examiner

*Primary Examiner* — Hoanganh Le
(74) *Attorney, Agent, or Firm* — Harrington & Smith

(57) ABSTRACT

A wireless electronic device is disclosed that includes one or more ground planes and an antenna electrically coupled to the one or more ground planes. The antenna is positioned adjacent to a portion of the one or more ground planes. The wireless electronic device includes a material placed in a position and having a dielectric constant selected to increase an effective electrical size of the one or more ground planes relative to the effective electrical size of the one or more ground planes without the material. Other wireless electronic devices and methods for forming the same are also disclosed.

32 Claims, 15 Drawing Sheets

ENHANCED RADIATION PERFORMANCE ANTENNA SYSTEM

TECHNICAL FIELD

This invention relates generally to wireless devices that use antennas and, more specifically, relates to improving radiation performance of the wireless devices.

BACKGROUND

Mobile electronic devices, such as mobile phones and other mobile devices, are getting smaller. Mobile electronic devices use antennas to receive and transmit information, and the size of the antennas is related to the frequency band being used. For instance half-wavelength and quarter wavelength antennas are commonly used. Typical antennas used in mobile electronic devices include planar inverted F-antenna (PIFA), planar inverted L-antenna (PILA), inverted L-antenna (ILA), inverted F-antenna (IFA), and whip antennas. Many antennas in mobile electronic devices are placed above or in close vicinity to a printed wiring board (PWB) (also called a printed circuit board) and couple electromagnetically to the ground plane of the PWB. Such coupling can be both beneficial and detrimental. For instance, a quarter-wavelength antenna uses the ground plane of the PWB to increase the effective size of the antenna.

However, due to the shrinking nature of mobile phone design, radiation performance has become more troublesome to achieve. Especially at low frequencies, this is a growing problem, since the PWB acts like a dipole antenna and most of the radiation actually comes from the ground plane and not the antenna itself. The optimal length, for the low frequency bands, of the PWB is about 120-130 mm (millimeters), from a radiation performance point of view. This is however not acceptable from an industrial design point of view. For instance, 120 mm is about 4.7 inches, which is too long for many common mobile phones.

Therefore, it would be beneficial to provide techniques for improving radiation performance of antennas, to decrease the physical size of the antenna, or both.

BRIEF SUMMARY

In an exemplary embodiment, a wireless electronic device is disclosed that includes one or more ground planes and an antenna electrically coupled to the one or more ground planes. The antenna is positioned adjacent to a portion of the one or more ground planes. The wireless electronic device includes a material placed in a position and having a dielectric constant selected to increase an effective electrical size of the one or more ground planes relative to the effective electrical size of the one or more ground planes without the material.

In an additional exemplary embodiment, a wireless electronic device is disclosed that includes circuitry grounding means and antenna means coupled to the circuitry grounding means. The antenna means is positioned adjacent to a portion of the circuitry grounding means. The wireless electronic device also includes means for increasing an effective electrical size of the circuitry grounding means relative to an effective electrical size of the at least one ground plane without the means for increasing.

In a further exemplary embodiment, a wireless electronic device includes at least one ground plane and at least one antenna electrically coupled to the at least one ground plane. The at least one antenna is positioned adjacent to a portion of the at least one ground plane. The wireless electronic device also includes a material having a dielectric constant selected to increase an electric size of the at least one ground plane when the material is placed in a predetermined region. The predetermined region has a predetermined level of electric field caused at least in part by the at least one ground plane when the at least one antenna is operational. The region is separated from the at least one antenna by a predetermined distance.

In yet another exemplary embodiment, a wireless electronic device is disclosed that includes circuitry grounding means and antenna means coupled to the circuitry grounding means. The antenna means is positioned adjacent to a portion of the circuitry grounding means. The wireless electronic device includes a means for providing a dielectric constant selected to increase an electric size of the circuitry grounding means when the means for providing is placed in a predetermined region. The predetermined region has a predetermined level of electric field caused at least in part by the circuitry grounding means when the antenna means is operational. The region is separated from the antenna means by a predetermined distance.

In another exemplary embodiment, a method is disclosed for forming a wireless device. The method includes providing at least one ground plane and providing at least one antenna electrically coupled to the at least one ground plane. The antenna is positioned adjacent to a portion of the at least one ground plane. The method includes placing a material in a predetermined region. The material has a dielectric constant selected to increase an electric size of the at least one ground plane when the material is placed in the predetermined region. The predetermined region has a predetermined level of electric field caused at least in part by the at least one ground plane when the at least one antenna is operational. The region is separated from the at least one antenna by a predetermined distance.

BRIEF DESCRIPTION OF THE DRAWINGS

The foregoing and other aspects of embodiments of this invention are made more evident in the following Detailed Description of Exemplary Embodiments, when read in conjunction with the attached Drawing Figures, wherein.

DETAILED DESCRIPTION OF EXEMPLARY EMBODIMENTS

As described above, radiation performance at low frequencies is a growing problem, since the PWB acts like a dipole antenna and most of the radiation actually comes from the ground plane and not the antenna itself. By making the PWB act as if the PWB had a larger electrical length, both bandwidth and radiation efficiency would be improved. This is obvious from FIG. 4 where the reflection coefficient is more improved at the left side. Also radiation efficiency (RE) is improved.

Figure 1:
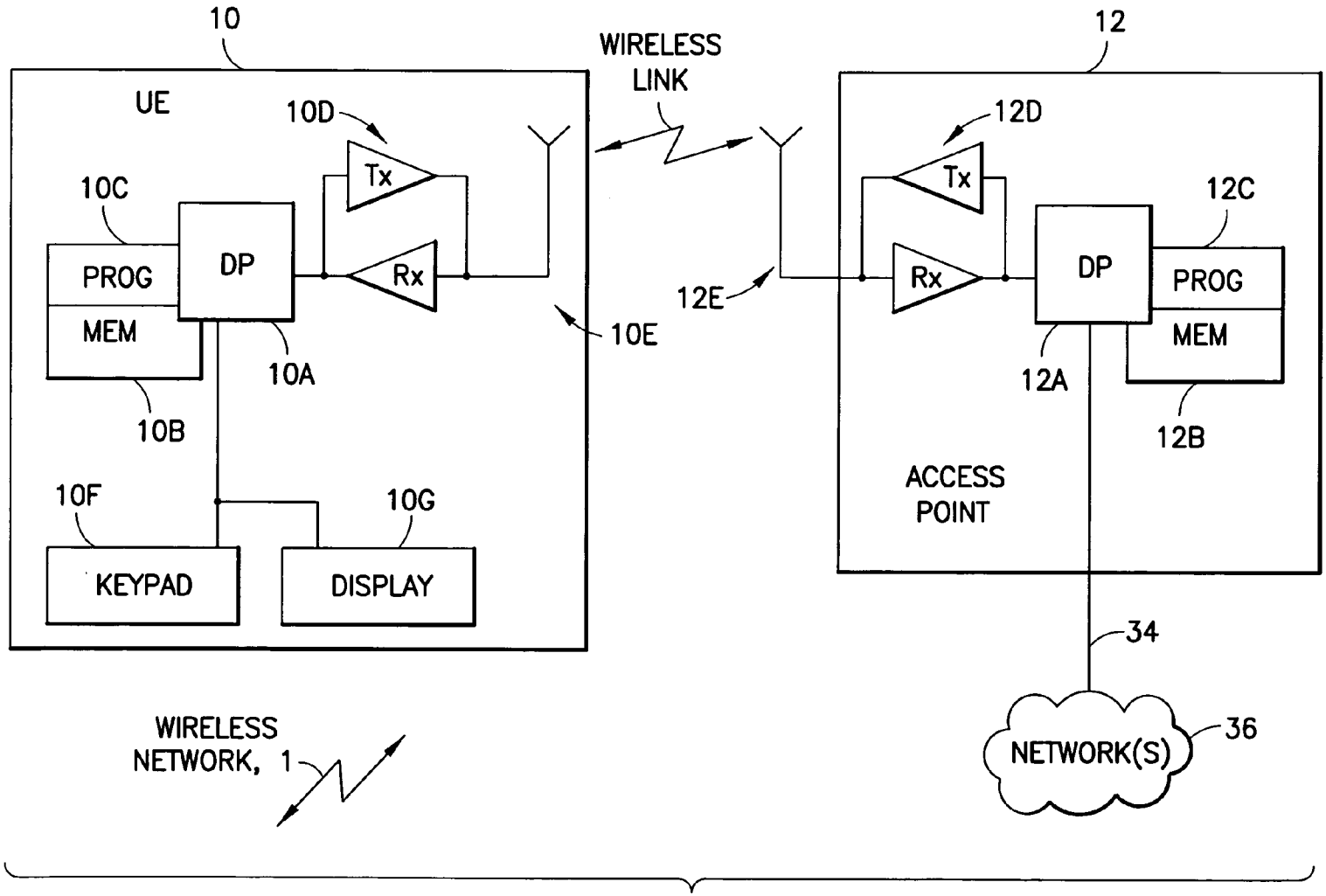
FIG. 1 is a simplified block diagram of a wireless communication system in which exemplary embodiments of the disclosed invention might be used.

Reference is made to FIG. 1 for illustrating a simplified block diagram of various electronic devices that are suitable for use in practicing the exemplary embodiments of this invention. In FIG. 1, a wireless network 1 is adapted for communication with a mobile electronic device 10 via an access point 12. The mobile electronic device 10 includes a data processor (DP) 10A, a memory (MEM) 10B coupled to the DP 10A, and a suitable RF transceiver 10D (having a transmitter (TX) and a receiver (RX)) coupled to the DP 10A. The MEM 10B stores a program (PROG) 10C. The DP 10A is coupled in this example to the keypad 10F and the display 10G. The transceiver 10D is for bidirectional wireless communications with the access point 12. Note that the mobile electronic device 10 has at least one antenna 10E to facilitate communication.

The access point 12 includes a data processor (DP) 12A, a memory (MEM) 12B coupled to the DP 12A, and a suitable RF transceiver 12D (having a transmitter (TX) and a receiver (RX)) coupled to the DP 12A. The MEM 12B stores a program (PROG) 12C. The transceiver 12D is for bidirectional wireless communications with the mobile electronic device 10. Note that the transceiver 12D has at least one antenna 12E to facilitate communication. The access point 12 is coupled via a data path 34 to one or more external networks 36, which could include, as examples, the Internet, a POTS (public switched telephone network), a local area network, or a wide areas network. The programs 10C, 12C are assumed to include program instructions that, when executed by the associated DP 10A, 12A, enable the electronic device to operate, e.g., to transmit or receive information using the associated transceiver 10D, 12D.

In general, the various embodiments of the mobile electronic device 10 can include, but are not limited to, cellular phones, personal digital assistants (PDAs) having wireless communication capabilities, portable computers having wireless communication capabilities, image capture devices such as digital cameras having wireless communication capabilities, gaming devices having wireless communication capabilities, music storage and playback appliances having wireless communication capabilities, Internet appliances permitting wireless Internet access and browsing, as well as portable units or terminals that incorporate combinations of such functions.

The MEMs 10C, 12C may be of any type suitable to the local technical environment and may be implemented using any suitable data storage technology, such as semiconductor based memory devices, magnetic memory devices and systems, optical memory devices and systems, fixed memory and removable memory, as non-limiting examples. The DPs 10A, 12A may be of any type suitable to the local technical environment, and may include one or more of general purpose computers, special purpose computers, microprocessors, digital signal processors (DSPs) and processors based on a multi core processor architecture, as non limiting examples.

In an exemplary embodiment, a high $\epsilon_r$ material (a material with high dielectric constant, $\epsilon_r$) is provided near an area of a PWB, having an antenna at one end, where the electrical field strength is large around the PWB. High $\epsilon_r$ materials are materials which typically have a dielectric constant greater than 5, but in an exemplary embodiment, a dielectric constant greater than 10 is suggested in order to see a substantial influence (as determined, e.g., through testing) on a technical effect described herein. In order to provide a dielectric constant of 10 or more, typically, and not limited to, materials containing base constituents of Alumina, Titania, Gallium Arsenide, Silicon, and the like, are deployed in the makeup of the overall high dielectric constant material. Typically available commercial microwave dielectric materials are complex mixed oxides, for example, Alumina ($Al_2O_3$). Other materials which combine these and other elements, for example, plastics can also be used. High dielectric constant materials are traditionally called ceramics, but other materials may also be used if their dielectric constant is high enough for the application or frequency band of interest where the technical effect within this invention is to be achieved.

The PWB is generally used in a mobile electronic device as the main or sole ground plane element, but sometimes the ground plane may not be limited to the PWB alone. The PWB is usually comprised of more than one conductive layer (typically of copper), whereby at least one layer could be used as a solid layer of copper for use as a ground plane. Other examples of ground plane elements in mobile electronic devices are conductive modules, shields, covers or cases, as an unlimited set of examples. If a PWB type ground plane is present in the mobile electronic device, then if these additional ground plane elements are adopted as ground plane elements, they are normally coupled to the main ground plane.

In an exemplary embodiment, the area to place the high $\epsilon_r$ material will generally be at the top or bottom end of the PWB, but the exact location of the high dielectric constant material may vary from the ends if the antenna type and mobile electronic device affect the distribution of currents flowing in the ground plane. In an exemplary embodiment, the end at which the high dielectric constant material is placed is the end opposite from the antenna. The opposite end is chosen in an exemplary embodiment so that the high dielectric constant material does not affect the performance of the antenna. Exemplary benefits of adding the high dielectric constant material include improving radiation performance of the antenna, which includes, e.g., an increase in bandwidth. Because the radiation performance of an antenna is improved, a physically smaller antenna might be used in certain implementations.

Examples of adding a high dielectric constant material include increasing the $\epsilon_r$ of a plastic support of a connector to which the PWB is connected, the $\epsilon_r$ of the phone cover, or a part thereof, or simply adding a piece of high $\epsilon_r$ material at an appropriate location. It may also be possible to add a high dielectric material to a surface, e.g., of a case, such as through sputtering or other deposition techniques. Any means may be used for providing a dielectric constant to increase an effective electrical size of a ground plane. Also, a complementary antenna with high $\epsilon_r$ support could preferably be located in the opposite end compared to the main antenna to achieve a beneficial effect on radiation performance of the latter. Complementary antennas, such as Bluetooth (BT), global positioning system (GPS), and the like, are often designed on a high $\epsilon_r$ carrier. If such a complementary antenna is located in a region of high electric field for the main antenna, the high $\epsilon_r$ material could be beneficial for the main antenna performance.

Figure 3:
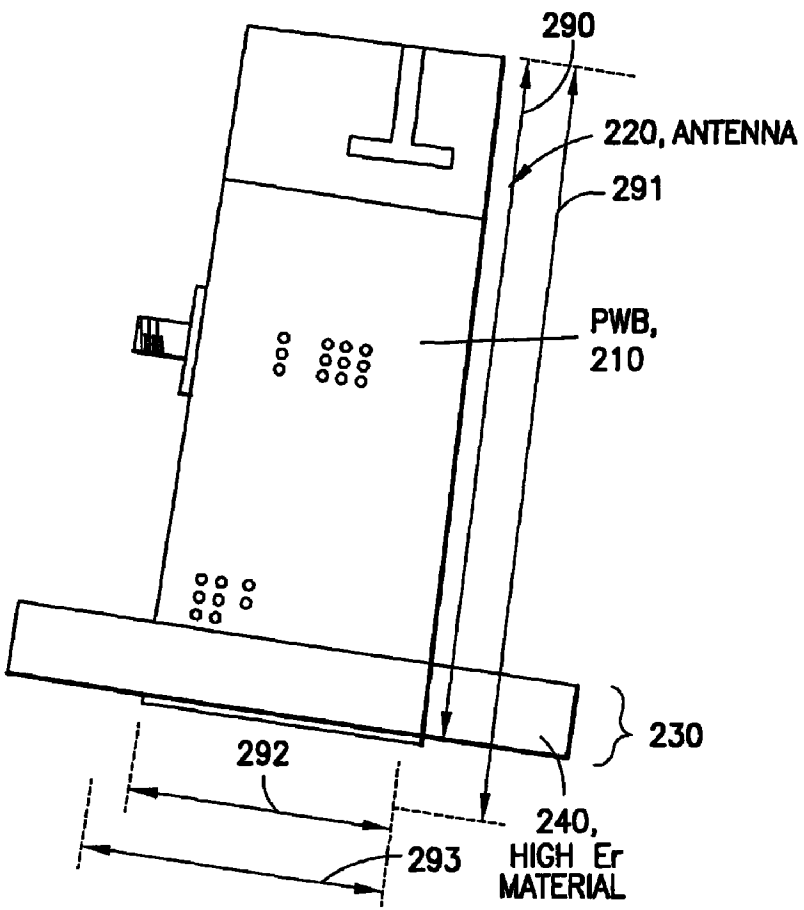
FIG. 3 is another view of the PWB of FIG. 2, but with a high dielectric constant material positioned in an area of high electric field.
Figure 2:
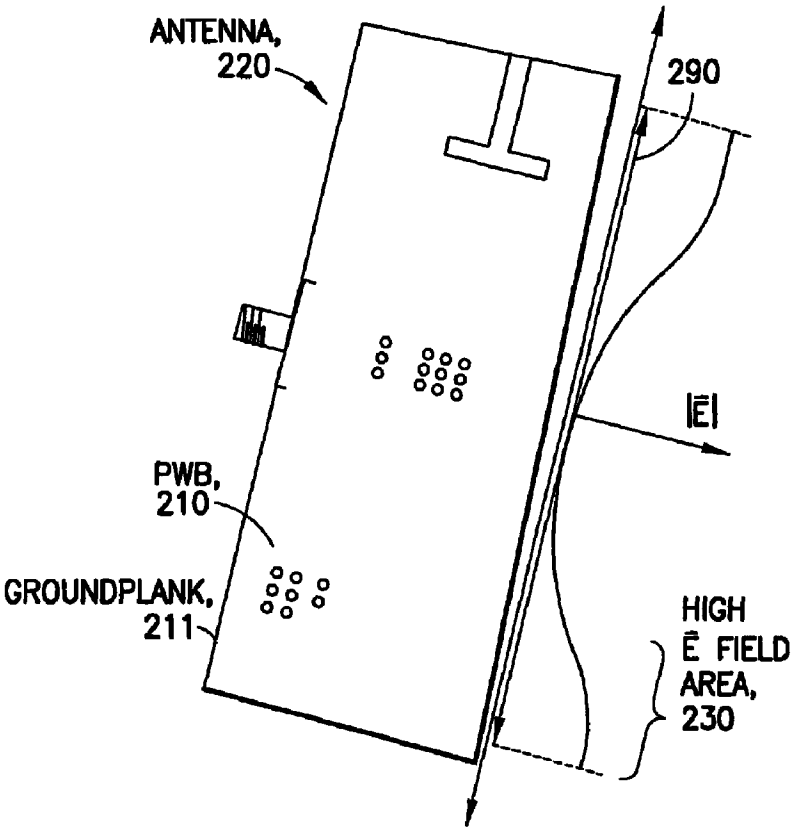
FIG. 2 is a view of an exemplary PWB for a cellular phone and shows an example of electric field strength.

Referring now to FIGS. 2 and 3, FIG. 2 is a view of an exemplary PWB 210 for a cellular phone and shows an example of electric field ($\bar{E}$) strength. The PWB includes an attached antenna 220. A high electric field area 230 is shown, which is caused because the ground plane 211 of the PWB 210 acts like one arm of a dipole. FIG. 3 is another view of the PWB of FIG. 2, but with a high dielectric constant material 240 positioned in the area 230 of high electric field. The dielectric constant of the material 240 in this example is 15.5. It is noted that the material 240 causes an effective length 291 of the ground plane 211, which is larger than the actual length 290 of the ground plane 211. It is also noted that material 240 may also cause the effective width 293 of the ground plane 211 to be larger than the actual width 292. It is also noted that the depictions shown in FIG. 2 and other figures of the increase in size of the ground plane due to the addition of a high dielectric constant material are solely for ease of explanation and are not meant to be actual depictions of the effects caused by the high dielectric constant material and placement thereof as described herein.

Figure 4:
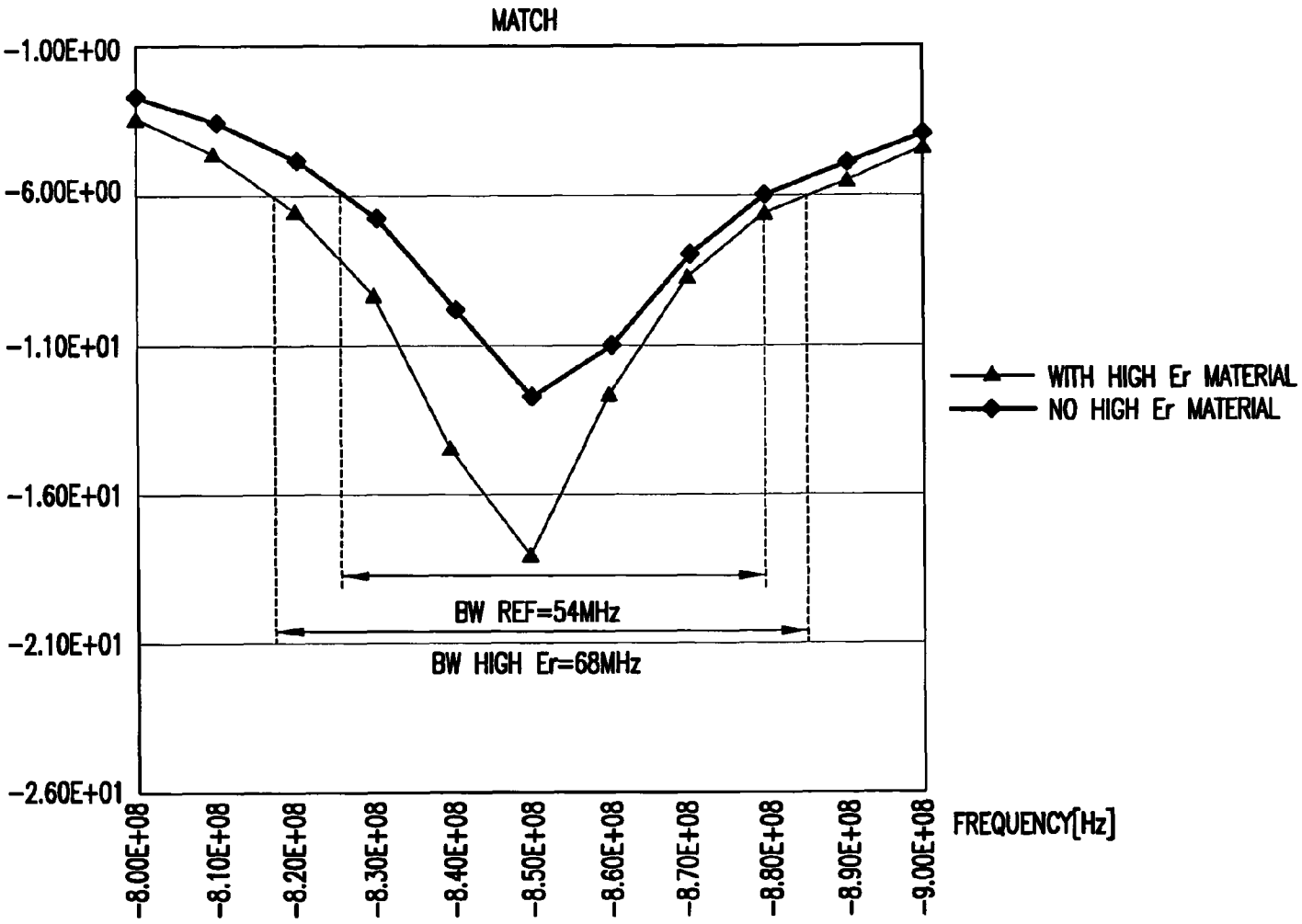
FIG. 4 is a graph showing bandwidth for configurations of FIGS. 2 and 3.

FIG. 4 is a graph showing bandwidth for configurations of FIGS. 2 and 3. FIG. 4 is a graph of the reflection coefficient versus frequency (800 MHz-900 MHz). It can be seen in FIG. 4 that the −6 dB bandwidth (BW) improves from a reference of 54 MHz (megahertz) for the PWB of FIG. 2 to 68 MHz when the high dielectric constant material ($\epsilon_r$=15.5) is used adjacent the PWB. This is an improvement of about 20 to 23 percent. It is also noted that the efficiency is improved.

Figure 5:
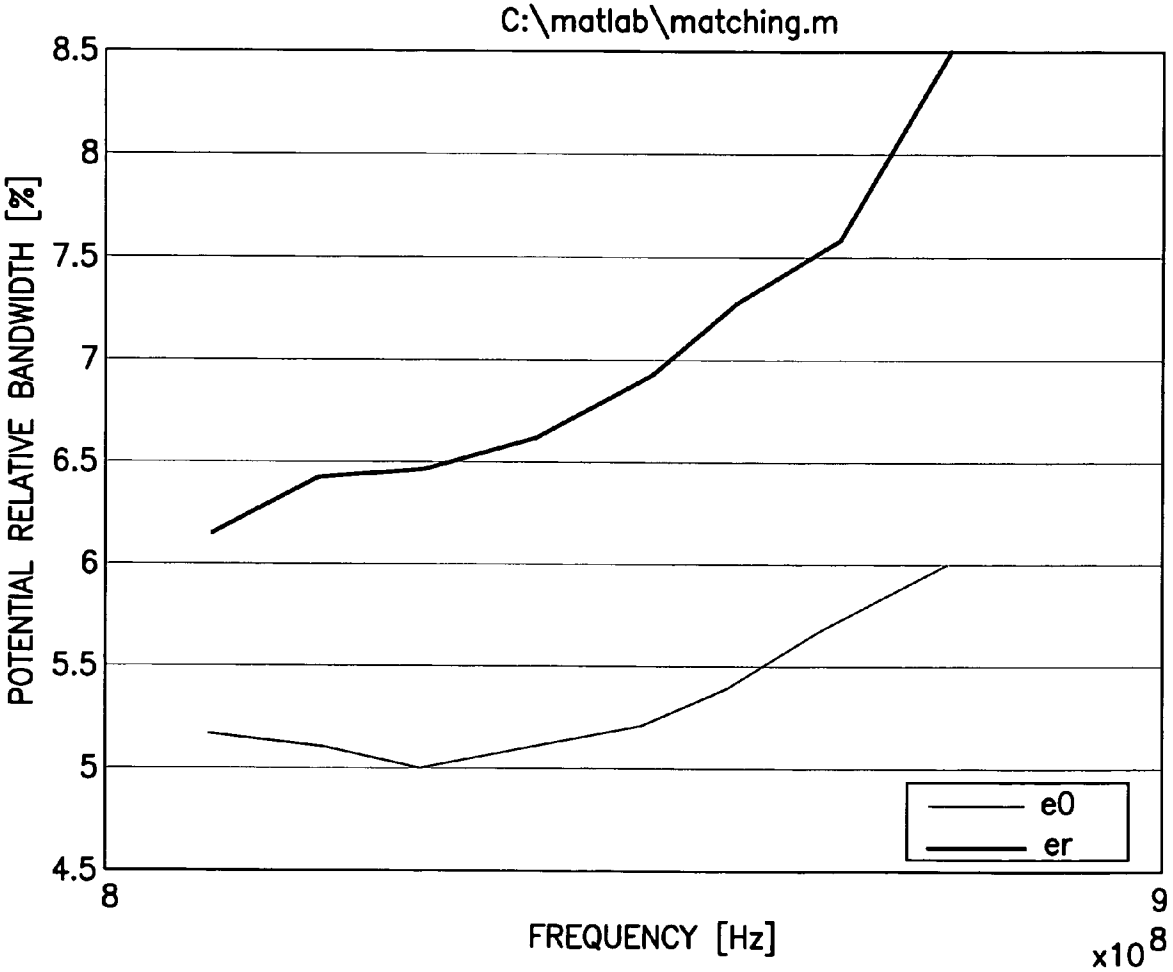
FIG. 5 is a graph of potentially achievable bandwidth.

FIG. 5 is a graph of potentially achievable bandwidth. The x-axis is from 800 MHz to 900 MHz, and one can see that at 850 MHz, one would determine approximately the 54 MHz bandwidth (no $\epsilon_r$ material) and 68 MHz bandwidth (with $\epsilon_r$ material) illustrated in FIG. 4. It can be seen that the potential relative bandwidth is consistently higher when the high $\epsilon_r$ material is used.

Figure 6:
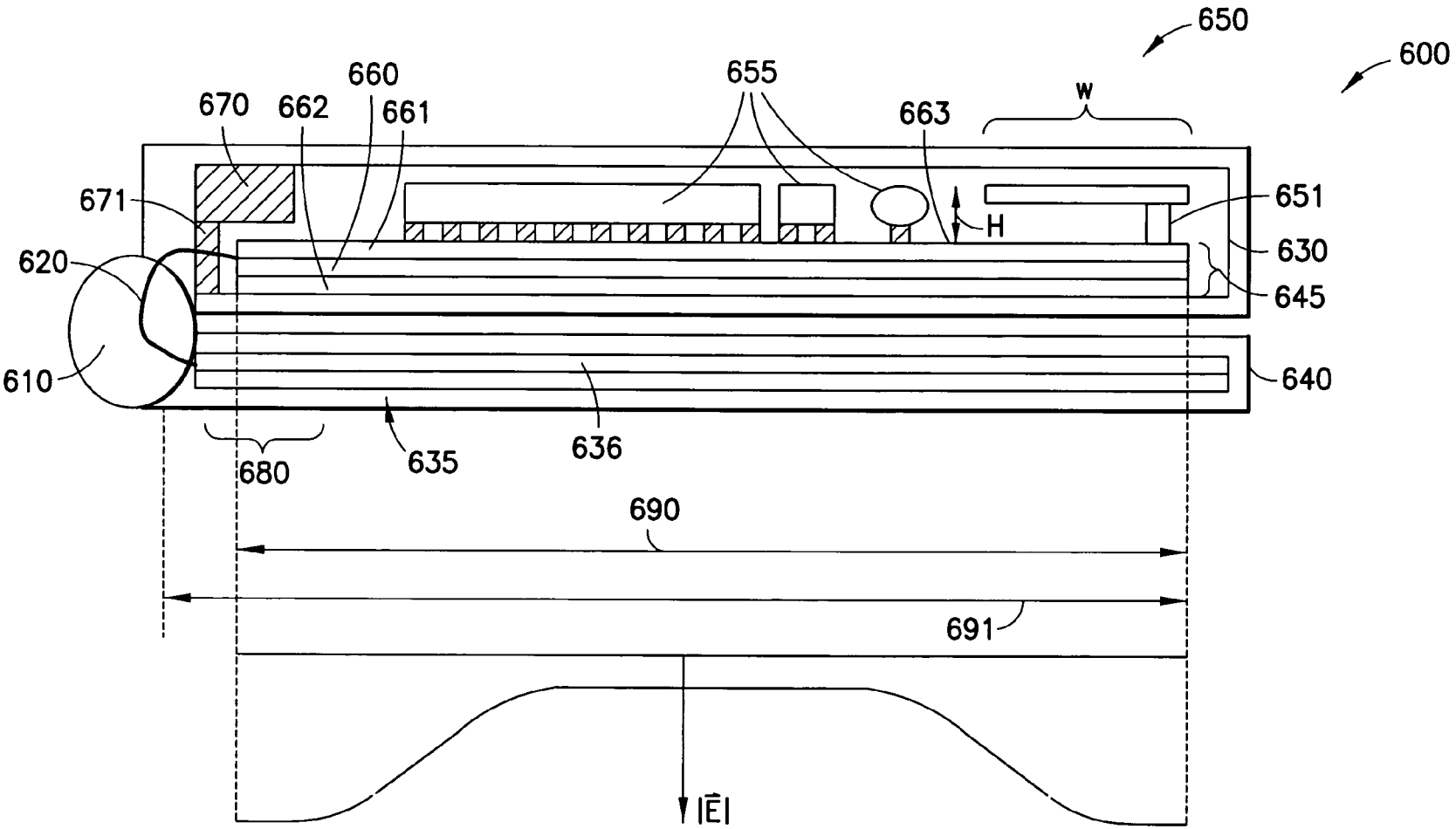
FIG. 6 is a simplified drawing of a side sectional view of a flip phone, shown in a closed position.

Turning to FIG. 6, a simplified drawing of a side sectional view of a flip phone 600 is shown. Flip phone 600 is shown in a closed mechanical state. The flip phone 600 includes a bottom case 630, a top case 640, and a hinge 610. The bottom case 630 includes a PWB 645 that includes a number of layers: dielectric layers 661, 662; ground plane 660; and a routing layer (not shown) on top surface 663. The electronic components 655 are in this example surface-mount components that are mounted to pads (not shown) on the top surface 663. An antenna 650 is electrically and mechanically (in this example) coupled to the PWB 645 through the conductor 651. The antenna 650 can be any type of antenna, and has certain dimensions. It is noted that the antenna(s) 650 (and other antennas herein) are antenna means, which can include any antenna(s) for receiving or transmitting radio frequencies. Also, the ground plane(s) in this and other examples are circuitry grounding means, e.g., for grounding the electronic components 655 and also the antenna 650. In this example, the dimensions include a height, H, above the top surface 663 of the PWB 645, a width, W, and a length, L, (see FIG. 9).

The high dielectric constant materials 670, 671 are formed as part of the cover 630 in an example. Such formation may occur, e.g., using co-injection molding for instance. In another exemplary embodiment, the high dielectric constant materials 670, 671 are attached to the cover 630, e.g., using glue, screws, matching plastic features on the materials 670, 671 and the cover 630, and another other possible attachment technique. The high dielectric constant material 670, 671 is placed in the area 680 that is determined to be a high electric field area for the PWB 645 in closed state (see electric field, $|\bar{E}|$, graph). It is noted that the cover 630 may have multiple pieces. The high dielectric constant material 670, 671 may be two different materials or two pieces of the same material. The high dielectric constant materials in this and other examples are means for increasing the effective electrical length of circuitry grounding means.

The upper case 640 includes a PWB 635, which includes its own ground plane 636. The ribbon cable 620 joins the PWBs 635, 645 and in particular joins the ground planes 636 and 660. The closed mechanical state of the flip phone 600 causes an effective electrical length 690, which is an effective electrical length of the PWBs 645, 635 (e.g., as coupled together using the ribbon cable 620) relative to the antenna 650. It is noted that the effective electrical length 690 is different from the actual length of the PWBs 645, 635. The materials 670, 671 increase the size of the effective electrical length 690 to the (exemplary) effective electrical length 691.

Figure 7:
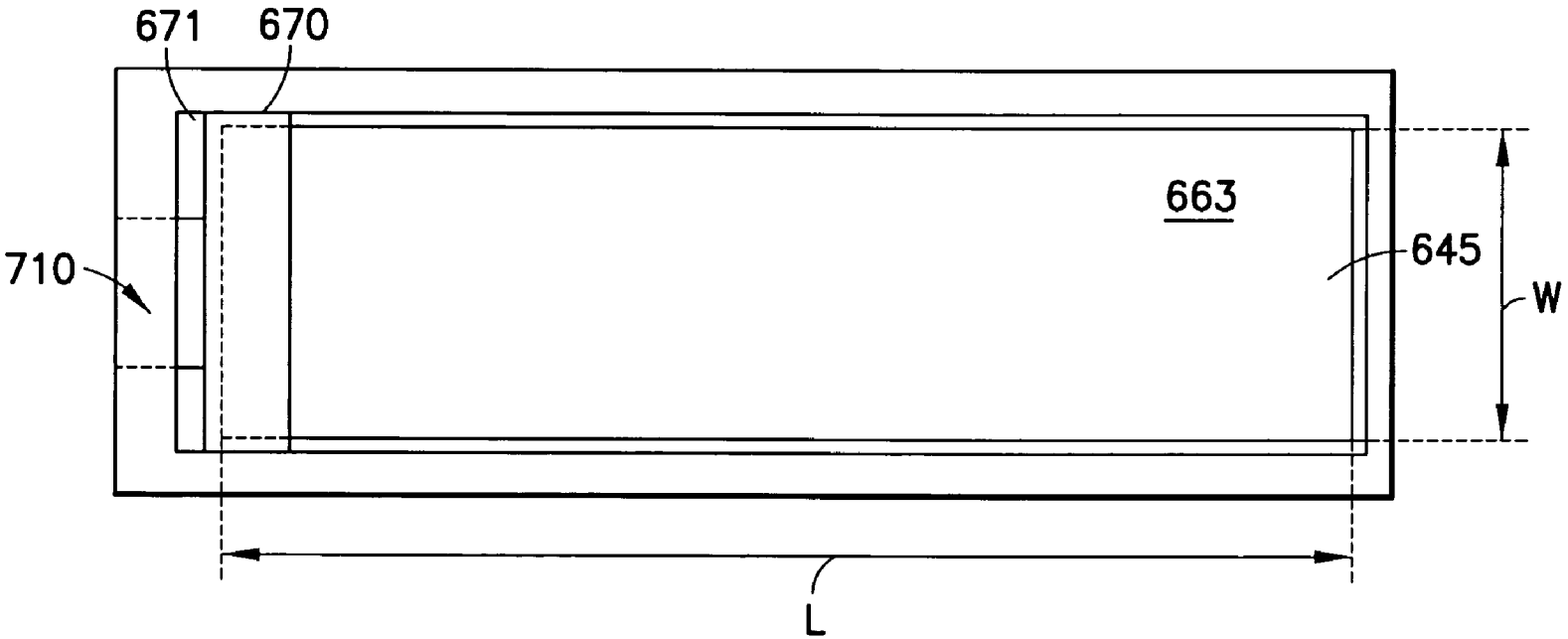
FIG. 7 is a top sectional view of the bottom case of the flip phone shown in FIG. 6.
Figure 8:
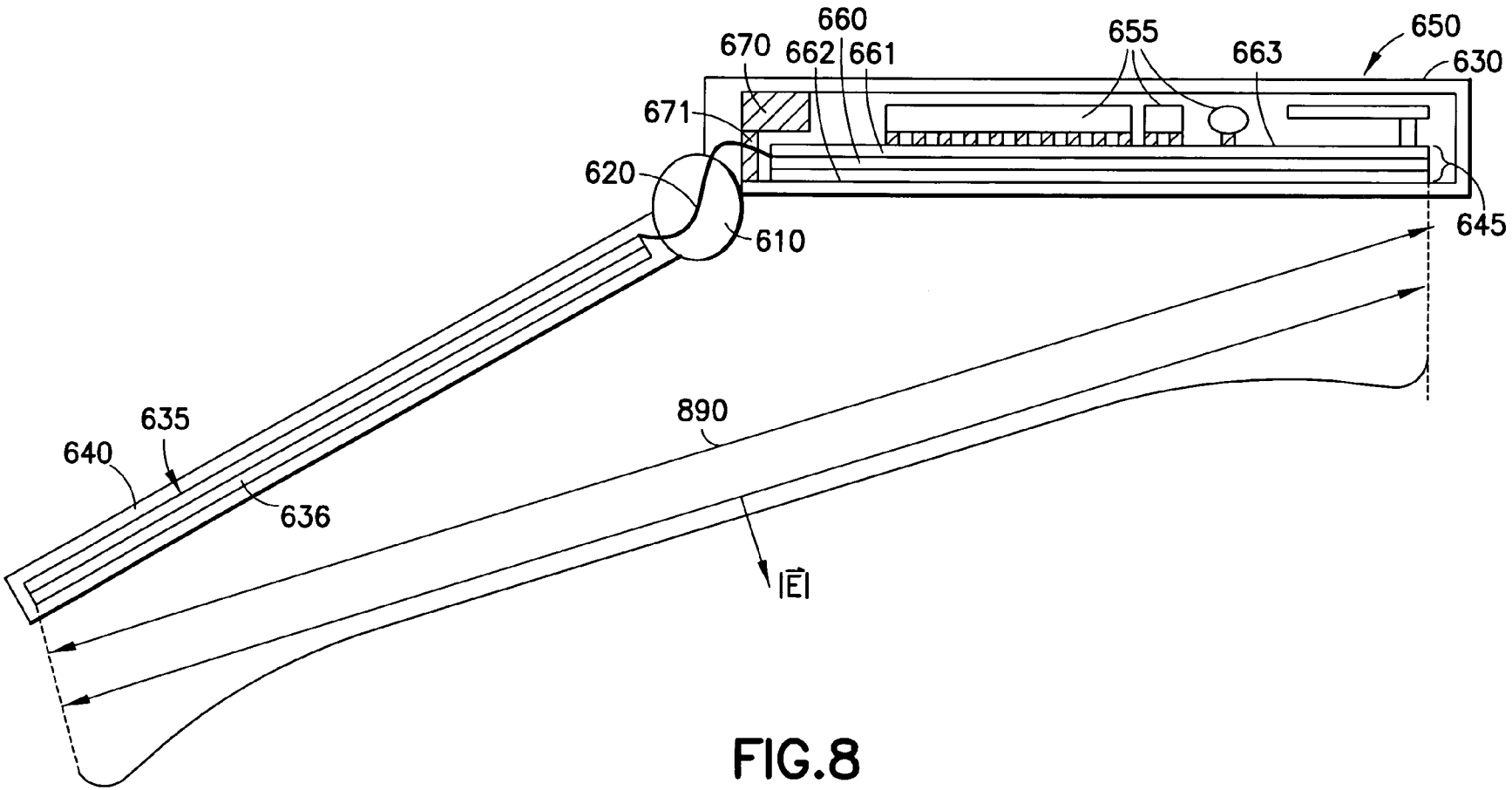
FIG. 8 is a simplified drawing of a side sectional view of a flip phone, shown in an open position.

FIG. 7 is a top sectional view of the bottom case of the flip phone shown in FIG. 6. An opening 710 can be seen, which is used to route the ribbon cable 620 to the PWB 635. The PWB 645 has a width, W, and a length, L. FIG. 8 is a simplified drawing of a side sectional view of a flip phone, shown in an open mechanical state. The effective electrical length 890 of the ground planes 636, 660 (and the ribbon cable 620) is relative to the antenna 650. The materials 671, 670 are now in an area of relatively low electric field, and therefore would have relatively little effect on the effective electrical length of the ground planes (e.g., the effective electrical length 890 would be approximately the same as the effective electrical length without the high dielectric materials 671, 670).

Figure 10:
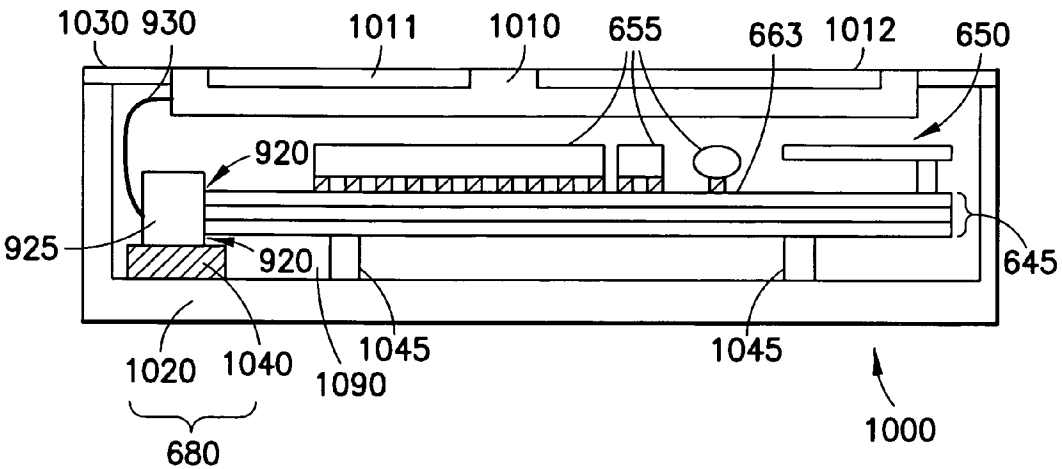
FIG. 10 is a side sectional view of a non-flip phone using the PWB shown in FIG. 9.
Figure 9:
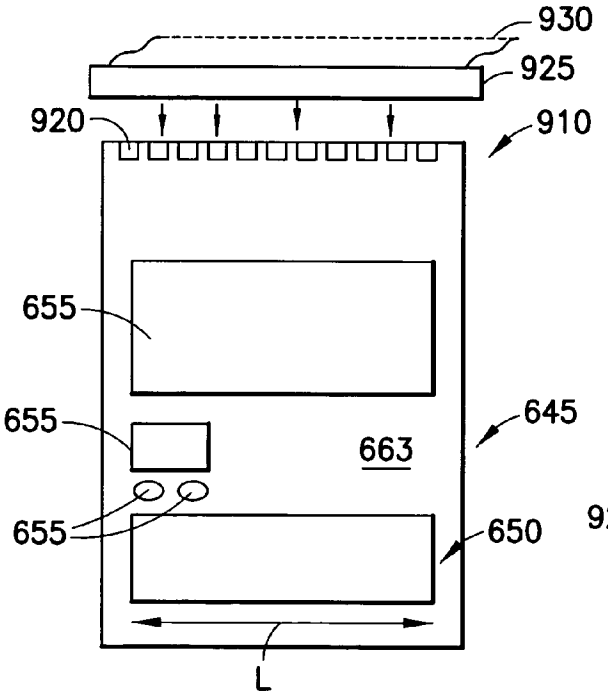
FIG. 9 is a top view of a PWB and associated connector.

Turning to FIGS. 9 and 10, FIG. 9 is a top view of a PWB and associated connector, while FIG. 10 is a side sectional view of a non-flip cellular phone using the PWB shown in FIG. 9. The PWB 645 in this example has an edge 910 having a number of pads on both the top surface 663 and the bottom surface 1090. An edge connector 925 has matching pads (not shown) to connect to the pads 920 and to couple the pads 920 to the ribbon cable 930. A high dielectric constant material is used in the support 1040 for the edge connector 925. The support 1040 is placed in an area 680 of high electric field caused by the PWB 645. The cellular phone 1000 has a bottom case 1020, which has integrated standoffs 1045, and a top case 1030. The ribbon cable 930 joins the PWB 645 with a case portion 1010 having a screen 1011 and a keypad 1012.

Figure 11:
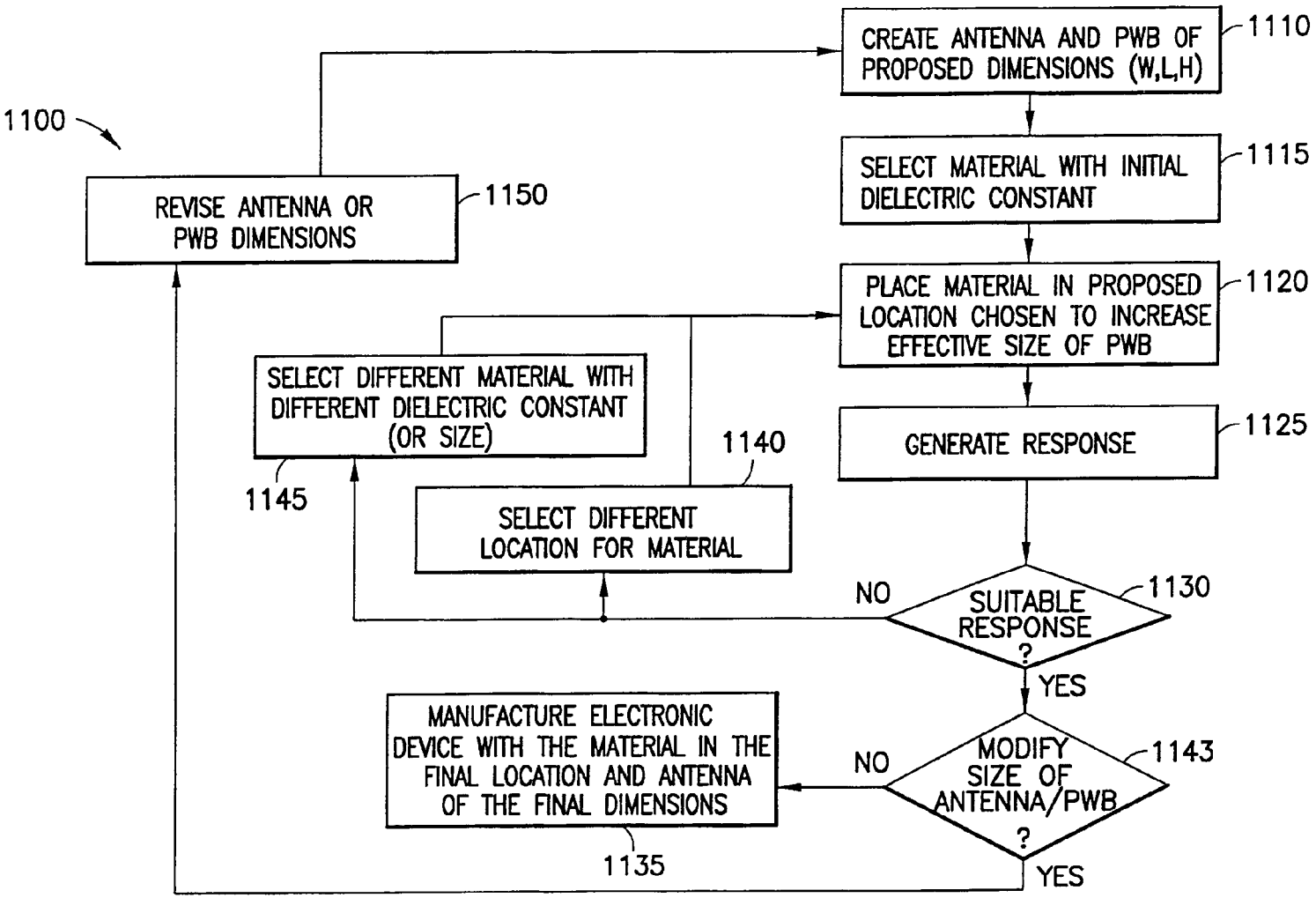
FIG. 11 is a flowchart of a method for using a material having a dielectric constant in an electronic device having an antenna.

FIG. 11 is a flowchart of a method 1100 for using a material having a dielectric constant in an electronic device having an antenna. Method 1100 begins in block 1110, when an antenna and PWB, each having certain proposed dimensions (e.g., W, L, H), are created. In block 1115, a material with a predetermined dielectric constant is chosen. Typically, materials with dielectric constants above 10 are chosen, but this is merely an example. In block 1120, the material is placed into a proposed location in the electronic device. The location is chosen to increase the electrical length of the PWB. In other words, the dominant property is that the electrical length gets longer as "seen" from the antenna feed and/or the ground point. The location is chosen to be placed where the electrical field is relatively large (e.g., where the electrical field has its maximum) compared to other locations on the PWB. See FIG. 2 for instance. The material includes, for instance, a plastic support of a connector to which the PWB is connected, a portion of the phone cover, or a piece of material.

In block 1125, the response is generated, which could be measured or simulated. In block 1130, it is determined if a suitable response has been achieved. The response would typically be predetermined, such as a 65 MHz bandwidth centered at 850 MHz. If a suitable response has been achieved (block 1130=YES), it is determined if the antenna size could be decreased (block 1143). For instance, if the response is better than a minimum response, the size of the antenna might be decreased. If the size of the antenna is not to be decreased (block 1143=NO), in block 1135, the electronic device (e.g., including the PWB and antenna, case, and other portions) is manufactured with the material in the final location and with the material of the final dimensions and in the final location. The antenna would also be made with the appropriate dimensions.

If a suitable response has not been achieved (block 1130=NO), a number of different options exist to improve the response. These options include selecting a different location for the high dielectric constant material (block 1140) and selecting a different material (e.g., having a higher dielectric constant) (block 1145). Note that block 1145 may also entail changing a size (e.g., width, length, depth) of the high dielectric constant material.

If the antenna size (or PWB size or both) is to be decreased (block 1143=YES), the dimensions of the antenna (or PWB size or both) are revised in block 1150. The blocks in method 1100 can be repeated a number of times, until a suitable response is achieved for a given antenna or an antenna size (or PWB size or both) is chosen to fit a particular response.

FIGS. 12, including 12A, 12B, 12C, 12D, and 12E, shows five views of a swivel phone shown in three different mechanical states. FIG. 12A shows a front view of the swivel phone 1200 in a closed mechanical state. Swivel phone 1200 includes a hinge 1210 and a first body 1220 that includes (in this example) a display 1205. FIG. 12B shows a side view of the swivel phone 1200 with the phone in the closed mechanical state. An upper PWB 1240 is located in the first body 1220, while a lower PWB 1250 is located in the second body 1230. One or more antennas (not shown) would be located on one or both of the PWBs 1240, 1250, e.g., at the location 1201. Meanwhile, a high dielectric material would be placed in the hinge area 1202 (e.g., within a predetermined distance from the hinge 1210) in an exemplary embodiment.

Figure 12A:
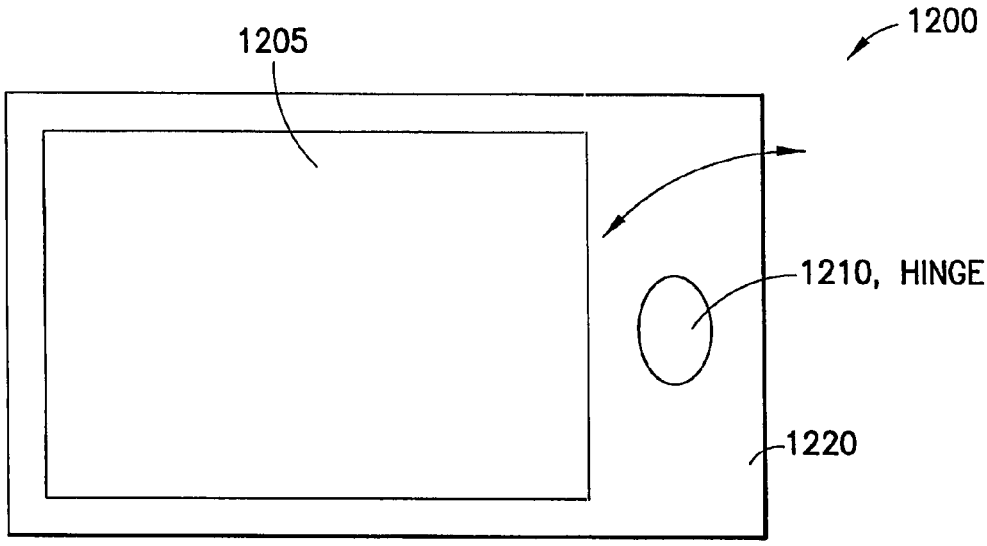
FIGS. 12, including 12A, 12B, 12C, 12D, and 12E, shows five views of a swivel phone shown in three different mechanical states.
Figure 12B:
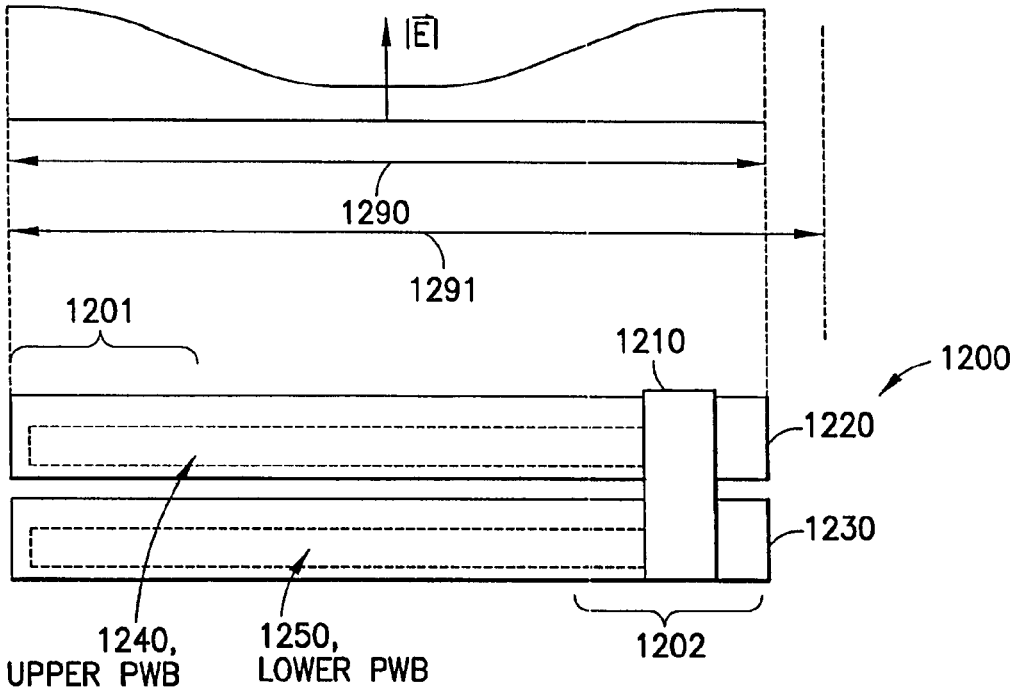
Figure 12C:
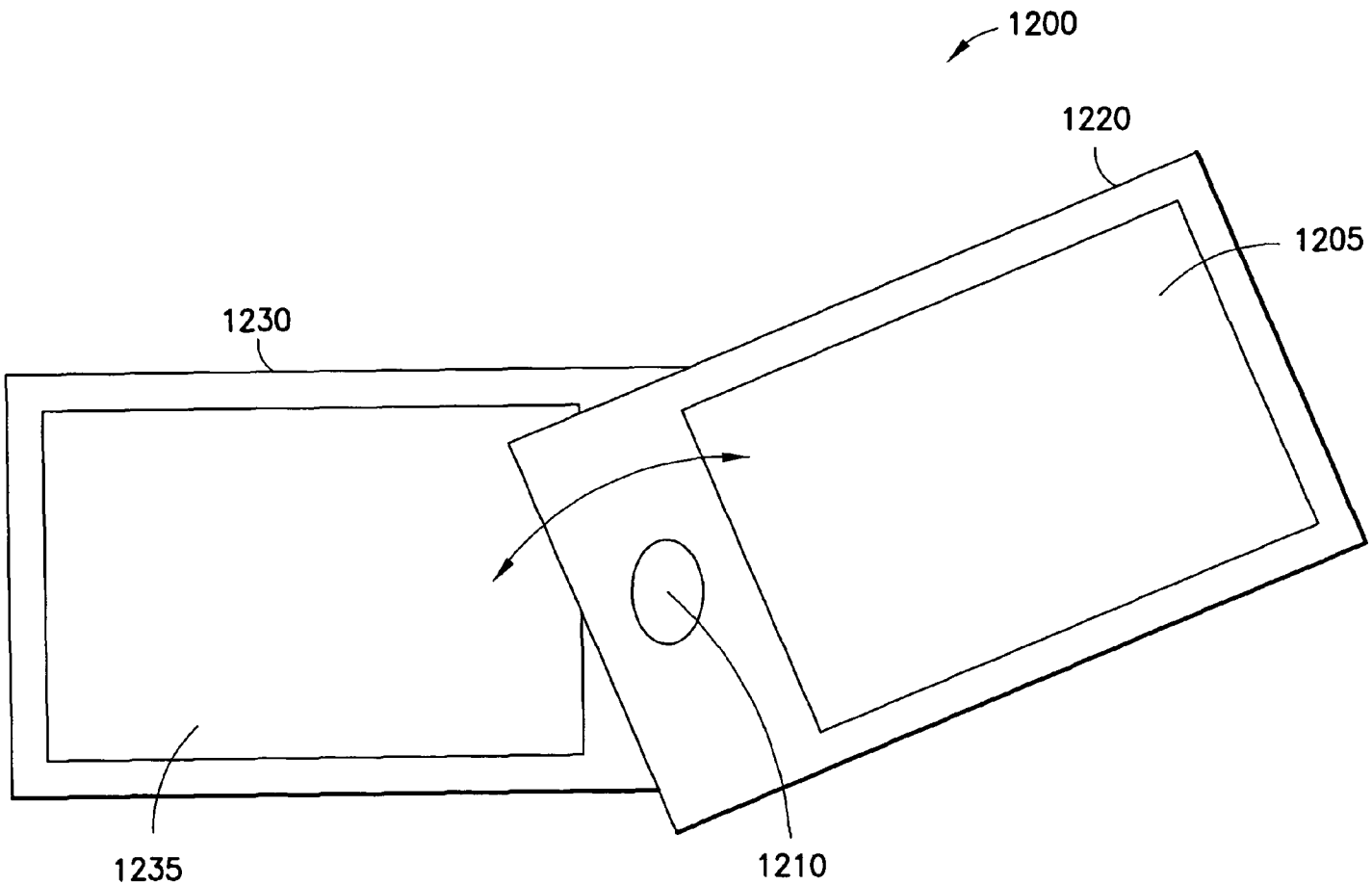
Figure 12D:
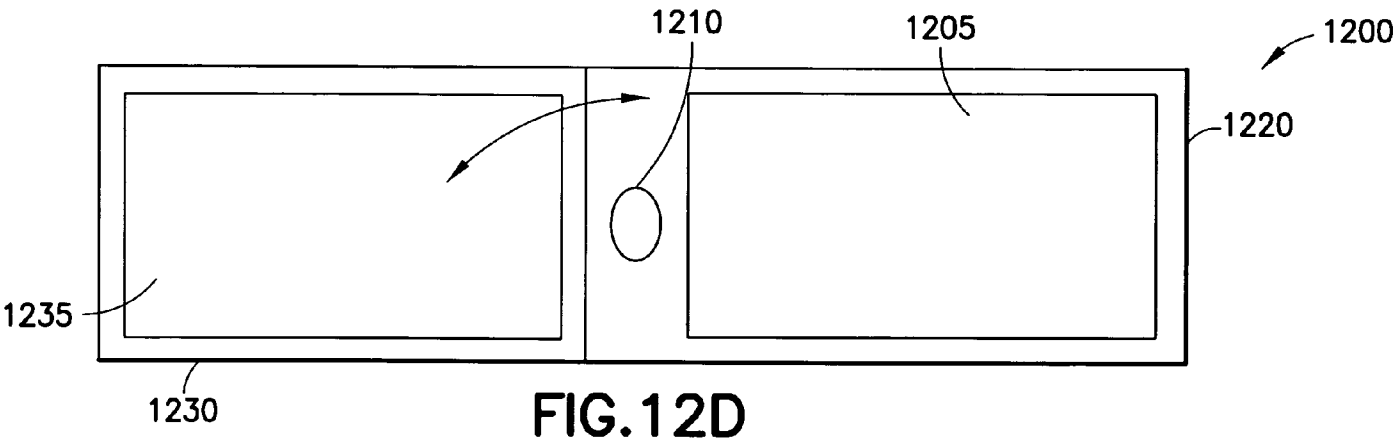
Figure 12E:
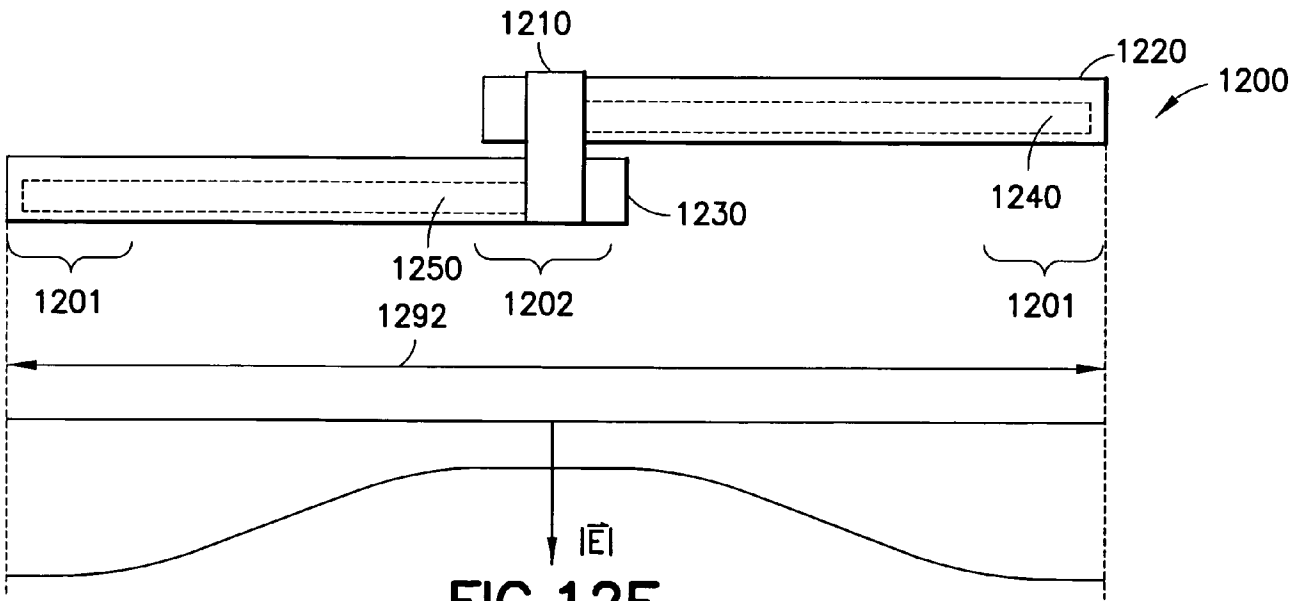

FIG. 12C shows the swivel phone 1200 in an intermediate mechanical state, such that the first body 1220 has been rotated about the hinge 1210 and relative to the second body 1230. A keypad 1235, in this example, can now be seen in the second body 1230. FIG. 12D is a front view of the swivel phone 1200 and shows the swivel phone 1200 in an open mechanical state. FIG. 12E is a side view of the swivel phone 1200, shown in the open mechanical state.

FIGS. 12B and 12E also show that the effective electrical length 1290 of the PWBs 1240, 1250 in the closed mechanical state is smaller than the effective electrical length 1292 in the open mechanical state. Additionally, the material placed in the hinge area 1202 would be positioned in an area of high electric field (e.g., a maximum electric field) (as shown in FIG. 12B) in the closed mechanical state but positioned in an area of low electric field (e.g., a minimum electric field) (as shown in FIG. 12E) in the open mechanical state. It is also noted the effective electrical length 1290 is increased by the use of the high dielectric constant material to the effective electrical length 1291 when in the closed mechanical state, but the high dielectric constant material leaves the effective electrical length 1292 (basically) unchanged relative to the effective electrical length that would occur without high dielectric constant materials.

Figure 13B:
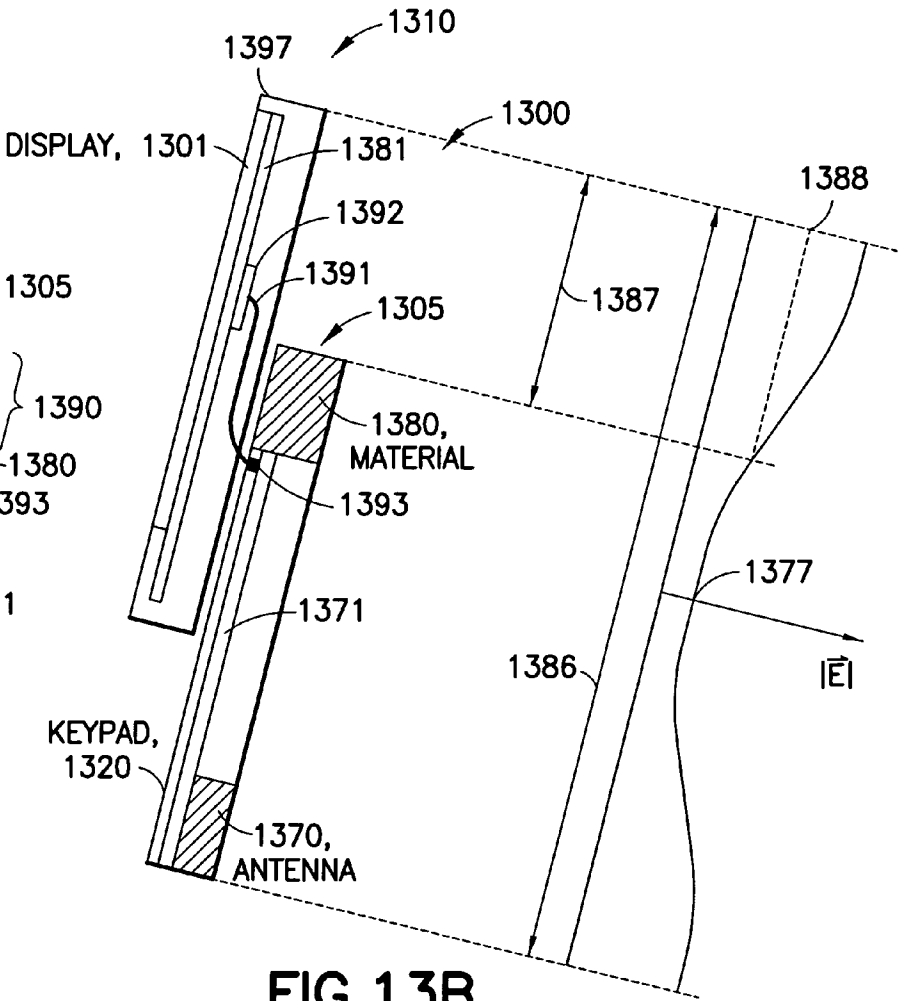
FIGS. 13, including 13A and 13B, shows two views of an exemplary slide phone shown in two different mechanical states.
Figure 13A:
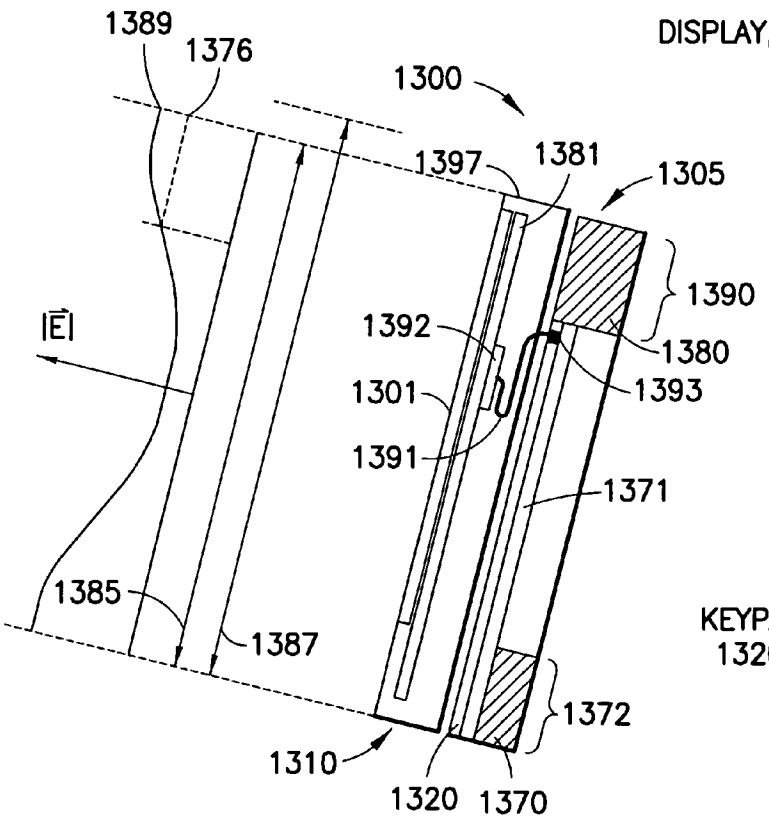

FIG. 13, including 13A and 13B, shows two views of a slide phone 1300 shown in two different mechanical states. FIG. 13A shows the slide phone 1300 in a closed mechanical state, while FIG. 13B shows the slide phone 1300 in an open mechanical state. The slide phone 1300 includes a fixed portion 1305 having a keypad 1320 and a movable portion 1310 having a display 1301. The high dielectric constant material 1380 in this example is placed in location 1390 inside fixed portion 1305 and adjacent a PWB/ground plane 1381 inside movable portion 1310. In this example, the antenna(s) 1370 are placed in location 1372, adjacent a PWB/ground plane 1371 inside fixed portion 1305. The PWB 1381 and the PWB 1371 are electrically coupled together through, e.g., cabling 1391 (e.g., a ribbon cable or flexible printed circuit) and connections 1392 and 1393.

It is noted that the material 1380 is near an edge 1397 when the phone 1300 is in the closed mechanical state but is away from the edge (e.g., by a predetermined distance 1387). Furthermore, in the closed mechanical state, the effective electrical length 1385 (without material 1380) of the PWBs/ground planes 1381, 1371 is smaller than the effective electrical length 1386 when the phone 1300 is in the open mechanical state. Additionally, the material 1380 is in a region of high electric field, $|\bar{E}|$, when the phone 1300 is in the closed mechanical state, but is in a region of low electric field when the phone 1300 is in the open mechanical state. In an exemplary embodiment, the location 1390 is selected such that a portion of the material 1380 overlaps the maximum electric field 1389 when the phone 1300 is in the closed mechanical stated and the antenna 1370 is operational. The effective electrical length 1387 is therefore improved (relative to the effective electrical length 1385 without material 1380) in the closed mechanical state when the material 1380 is added. In another exemplary embodiment, the location 1390 is further selected to be positioned such that a portion of the material 1380 overlaps the minimum electric field 1377 in the open mechanical state of the phone 1300. In a further exemplary embodiment, the location 1390 is further selected to be positioned such that a portion of the material 1380 overlaps a predetermined (e.g., low) electric field 1388 in the open mechanical state of the phone 1300. In yet another example, the location 1390 is further selected to be positioned such that a portion of the material 1380 overlaps a predetermined (e.g., high) electric field 1376 in the closed mechanical state of the phone 1300.

Figure 14A:
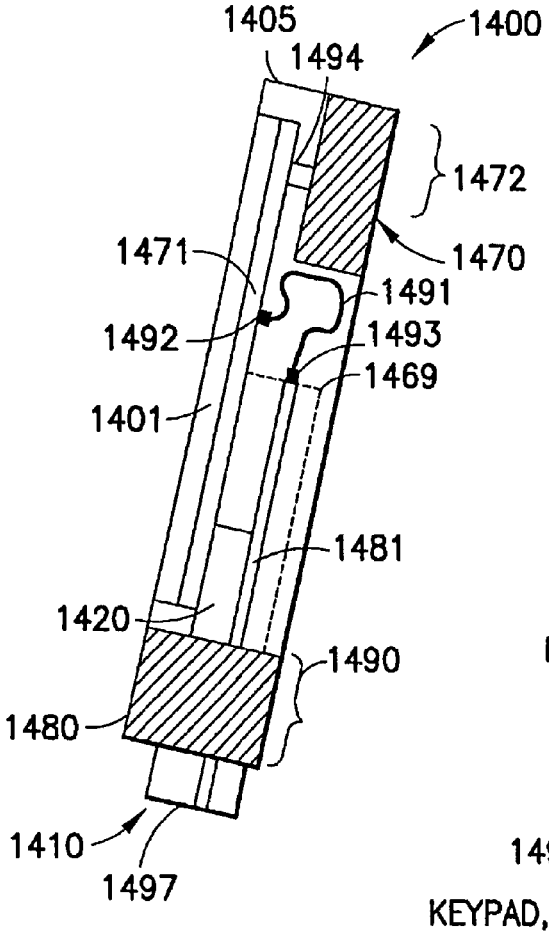
FIGS. 14, including 14A and 14B, shows two views of an exemplary slide phone shown in two different mechanical states.
Figure 14B:
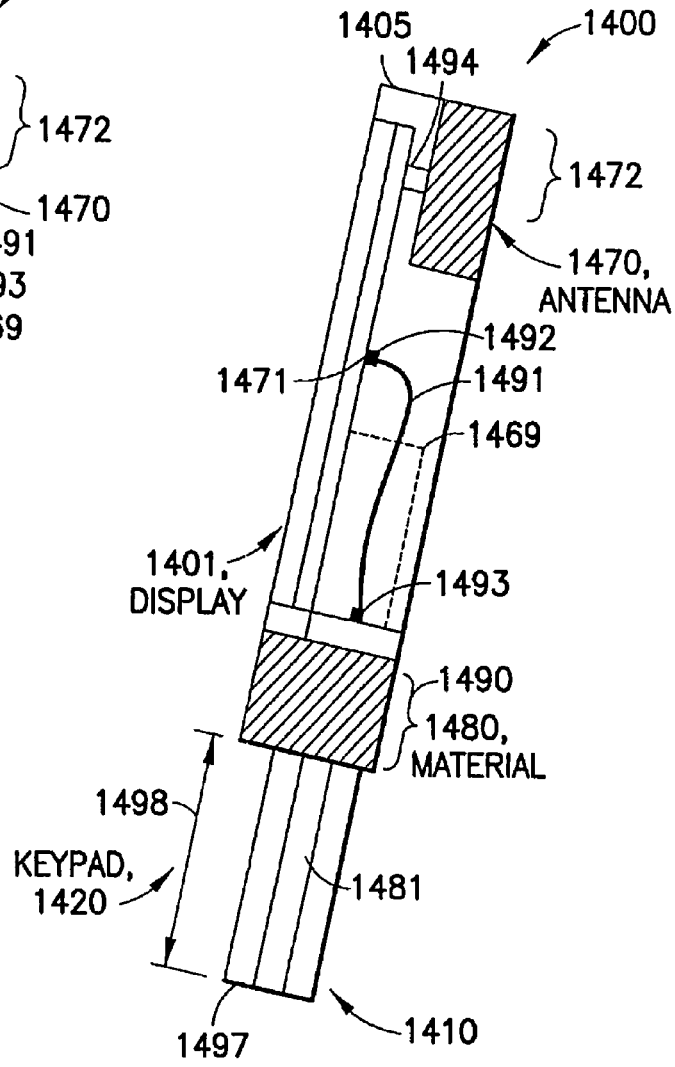

FIG. 14, including 14A and 14B, shows two views of another exemplary slide phone 1400 shown in two different mechanical states. FIG. 14A shows the slide phone 1400 in a closed mechanical state, while FIG. 14B shows the slide phone 1400 in an open mechanical state. The slide phone 1400 includes a fixed portion 1405 having a display 1401 and a movable portion 1410 having a keypad 1420. The high dielectric constant material 1480 in this example is placed in location 1490 inside fixed portion 1405 and adjacent a PWB/ground plane 1471 inside fixed portion 1405. The display 1401 is electronically and mechanically coupled to the PWB 1471, and the keypad 1420 is electronically and mechanically coupled to the PWB 1481. The antenna(s) 1470 are placed in location 1472, and are also adjacent the PWB/ground plane 1471 inside fixed portion 1405. The antenna(s) are coupled to the PWB/ground plane 1471 through feed 1494. The movable portion 1410 has a PWB/ground plane 1481, which is electrically coupled to the PWB/ground plane 1471 through the cabling 1491 and connections 1492, 1493. The material 1480 is adjacent an end 1497 of the phone 1400 when the phone 1400 is in the closed mechanical state, but is separated from the edge 1497 (e.g., by the predetermined distance 1498) when the phone 1400 is in the open mechanical state. Although not shown in FIG. 14, the location is further selected to be positioned such that a portion of the material 1480 overlaps a predetermined (e.g., high) electric field in the closed mechanical state of the phone 1400 and overlaps a predetermined (e.g., low) electric field in the open mechanical state of the phone 1400.

Figure 15A:
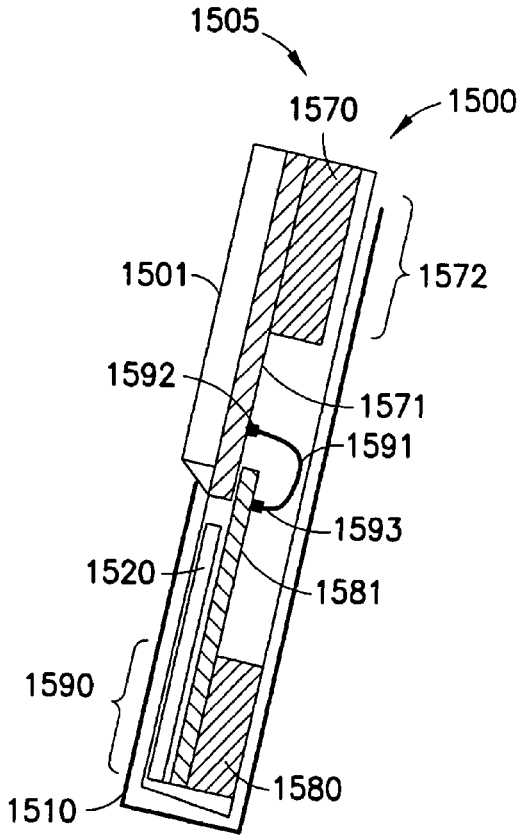
FIGS. 15, including 15A and 15B, shows two views of an exemplary slide phone shown in two different mechanical states.
Figure 15B:
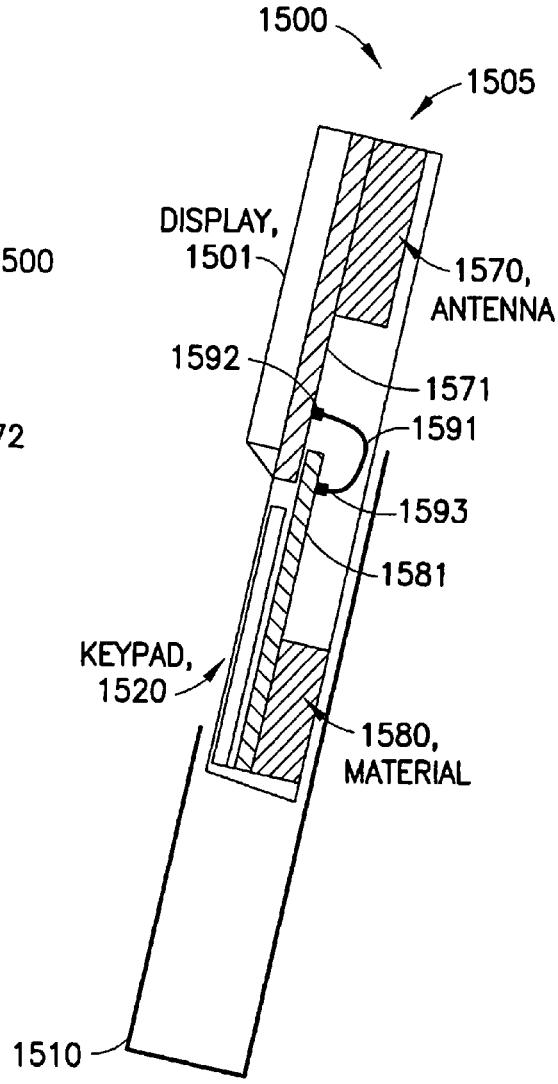

FIG. 15, including 15A and 15B, shows two views of another exemplary slide phone 1500 shown in two different mechanical states. FIG. 15A shows the slide phone 1500 in a closed mechanical state, while FIG. 15B shows the slide phone 1500 in an open mechanical state. The slide phone 1500 includes a fixed portion 1505 having a display 1501 and a keypad 1520. The slide phone 1500 also includes a movable portion 1510. The high dielectric constant material 1580 in this example is placed in location 1590 inside fixed portion 1505 and adjacent a PWB/ground plane 1581 inside fixed portion 1505. The display 1501 is electronically and mechanically coupled to the PWB 1571, and the keypad 1520 is electronically and mechanically coupled to the PWB 1581. The antenna(s) 1570 are placed in location 1572, and are also adjacent the PWB/ground plane 1571 inside fixed portion 1505. The movable portion 1510 is a body that moves relative to the fixed portion 1510. The PWB/ground planes 1571 and 1581, are electrically coupled through the cabling 1591 and connections 1592, 1593.

Exemplary benefits to embodiments of the disclosed invention include that even smaller antennas may be made or for a given size of antenna, an improvement in performance (e.g., as measured by bandwidth and radiation efficiency) can be had.

It is noted that although cellular phones have been discussed primarily herein, the techniques of the disclosed invention are also applicable to any other wireless electronic device. It is also noted that the exemplary techniques herein may also be applied to many different types of antennas, including as non-limiting examples planar inverted F-antenna (PIFA), planar inverted L-antenna (PILA), ILA, IFA and whip antennas. It is further noted that an increase in effective electrical "length" of a ground plane also increases an effective electrical size of the ground plane. Furthermore, the effective electrical width of a ground plane could also be increased using the techniques provided herein.

It is further noted that PWBs have been primarily discussed herein, but the techniques of the disclosed invention are suitable for use wherever an antenna is placed adjacent one or more ground planes. For example, flexible circuitry is becoming more popular and a ground plane can be implemented thereon, with or without corresponding signal layers on the flexible circuitry. Such flexible circuitry might not technically be considered a "printed wiring board" but should still be encompassed by the techniques herein.

The foregoing description has provided by way of exemplary and non-limiting examples a full and informative description of the best techniques presently contemplated by the inventors for carrying out embodiments of the invention. However, various modifications and adaptations may become apparent to those skilled in the relevant arts in view of the foregoing description, when read in conjunction with the accompanying drawings and the appended claims. All such and similar modifications of the teachings of this invention will still fall within the scope of this invention.

Furthermore, some of the features of exemplary embodiments of this invention could be used to advantage without the corresponding use of other features. As such, the foregoing description should be considered as merely illustrative of the principles of embodiments of the present invention, and not in limitation thereof.

For instance, the high dielectric constant material can include a number of pieces, whether or not the material is formed as part of the case, a connector, a support for the connector, or as separate pieces attached to the case or other structure. Furthermore, at least multiple items of the following list can be combined: the high dielectric constant material can include one or multiple pieces; the ground plane can be part of one or multiple PWBs; the dielectric constant of the material can be above 10; various wireless electronic devices can have multiple mechanical states and the high dielectric constant material is located in regions of high (e.g., maximum) electric field or low (e.g., minimum) electric field depending on particular mechanical states; and the high dielectric constant material could be placed at an opposite end of the ground plane from the antenna.

What is claimed is:

1. A wireless electronic device comprising:

at least one ground plane;

an antenna electrically coupled to the at least one ground plane, the antenna positioned in a first position adjacent to a portion of the at least one ground plane, where the antenna is configured to cause the at least one ground plane at least in part to have an electric field; and a material positioned in a second position located in a high level of the electric field relative to other levels of the electric field, different from the first position, the material having a predetermined dielectric constant greater than a threshold dielectric constant to increase an effective electrical size of the at least one ground plane relative to an effective electrical size of the at least one ground plane without the material.

2. The wireless electronic device of claim 1, wherein the at least one ground plane is part of at least one printed wiring board.

3. The wireless electronic device of claim 2, wherein the at least one ground plane comprises a plurality of ground planes, each ground plane is part of a corresponding printed wiring board, and wherein all of the ground planes are electrically coupled together.

4. The wireless electronic device of claim 1, further comprising at least one case used to house the at least one ground plane and the at least one antenna, and wherein the material is formed as a portion of the at least one case.

5. The wireless electronic device of claim 1, further comprising at least one case used to house the at least one ground plane and the at least one antenna and a connector coupled to one of the at least one ground plane, and wherein the material comprises a support positioned between the connector and a portion of the at least one case.

6. The wireless electronic device of claim 1, wherein the material comprises a plurality of pieces.

7. The wireless electronic device of claim 1, wherein the threshold dielectric constant is greater than 5.

8. A wireless electronic device comprising:

at least one ground plane;

at least one antenna electrically coupled to the at least one ground plane, the at least one antenna positioned adjacent to a portion of the at least one ground plane, where the at least one antenna is configured to cause the at least one ground plane at least in part to have an electric field; and a material having a predetermined dielectric constant greater than a threshold dielectric constant to increase an electric size of the at least one ground plane, where the material is placed in a predetermined region located in a high level of the electric field relative to other levels of the electric field and separated from the at least one antenna by a first predetermined distance.

9. The wireless electronic device of claim 8, wherein the at least one ground plane is part of at least one printed wiring board.

10. The wireless electronic device of claim 9, wherein the at least one ground plane comprises a plurality of ground planes, each ground plane is part of a corresponding printed wiring board, and wherein all of the ground planes are electrically coupled together.

11. The wireless electronic device of claim 8, wherein the high level of the electric field is a maximum level of the electric field.

12. The wireless electronic device of claim 8, further comprising a keypad and a display.

13. The wireless electronic device of claim 8, further comprising at least one case used to house the at least one ground plane and the at least one antenna, and wherein the material is formed as a portion of the at least one case.

14. The wireless electronic device of claim 8, further comprising at least one case used to house the at least one ground plane and the at least one antenna and a connector coupled to one of the at least one ground plane, and wherein the material comprises a support positioned between the connector and a portion of the at least one case.

15. The wireless electronic device of claim 8, wherein the material comprises a plurality of pieces.

16. The wireless electronic device of claim 8, wherein the threshold dielectric constant is greater than 10.

17. The wireless electronic device of claim 8, wherein the device has at least first and second mechanical states, and wherein the predetermined region is located in an area where the electric field has a first value in the first mechanical state and a second value in the second mechanical state.

18. The wireless electronic device of claim 17, wherein the first value is a value corresponding to the high level of the electric field relative to the other levels of the electric field and wherein the second value is a value corresponding to a minimum level of the electric field relative to the other levels of the electric field.

19. The wireless electronic device of claim 17, wherein the at least one ground plane in the first mechanical state has a shorter effective electrical length than the at least one ground plane has in the second mechanical state.

20. The wireless electronic device of claim 17, wherein the wireless electronic device comprises a fold phone and wherein the material is positioned within a second predetermined distance from a hinge of the fold phone.

21. The wireless electronic device of claim 17, wherein the wireless electronic device comprises a swivel phone and wherein the material is positioned within a second predetermined distance from a hinge of the swivel phone.

22. The wireless electronic device of claim 17, wherein the wireless electronic device comprises a slide phone and wherein the material is positioned adjacent an edge of the slide phone in the first mechanical state but is positioned a second predetermined distance away from the edge of the slide phone in the second mechanical state.

23. The wireless electronic device of claim 8, wherein the at least one antenna is adjacent to an end of one of the at least one ground plane and wherein the material is positioned adjacent an opposite end of the one ground plane.

24. A wireless electronic device comprising:

circuitry grounding means;

antenna means coupled to the circuitry grounding means, the antenna means positioned adjacent to a portion of the circuitry grounding means; and a dielectric means for providing a predetermined dielectric constant greater than a threshold dielectric constant and for increasing an electric size of the circuitry grounding means when the dielectric means is positioned in a predetermined region, the predetermined region having a predetermined level of electric field caused at least in part by the circuitry grounding means and the antenna means, and wherein the predetermined region is separated from the antenna means by a first predetermined distance.

25. The wireless electronic device of claim 24, wherein the circuitry grounding means is part of at least one printed wiring board.

26. The wireless electronic device of claim 24, wherein the circuitry grounding means comprises a plurality of circuitry grounding means, and wherein all of the plurality of circuitry grounding means are electrically coupled together.

27. A method for forming a wireless electronic device, comprising:

providing at least one ground plane;

providing at least one antenna electrically coupled to the at least one ground plane, the antenna positioned adjacent to a portion of the at least one ground plane;

determining a region having a predetermined level of electric field caused at least in part by the at least one ground plane and the at least one antenna, wherein the region is separated from the at least one antenna;

selecting a material with a predetermined dielectric constant greater than a threshold dielectric constant to increase an electric size of the at least one ground plane when the material is placed in the region; and placing the material in the region.

28. The method of claim 27 wherein the at least one ground plane is part of at least one printed wiring board.

29. The method of claim 28, wherein the at least one ground plane comprises a plurality of ground planes, each ground plane is part of a corresponding printed wiring board, and wherein the method includes electrically coupling all of the ground planes.

30. The method of claim 27, where the region is a location of the at least one ground plane where the electrical field is relatively large compared to other locations of the at least one ground plane.

31. The method of claim 27, where the at least one ground plane is embodied in a device having at least two mechanical states and where the region is a location of the at least one ground plane where the electrical field is relatively large compared to other locations of the at least one ground plane when the device is in a first mechanical state.

32. The method of claim 31, where the region is a location of the at least one ground plane where the electrical field is relatively small compared to other locations of the at least one ground plane when the device is in a second mechanical state.

* * * * *